US007145521B2

(12) United States Patent
Weitbruch et al.

(10) Patent No.: US 7,145,521 B2
(45) Date of Patent: Dec. 5, 2006

(54) METHOD FOR PROCESSING VIDEO PICTURES FOR DISPLAY ON A DISPLAY DEVICE

(75) Inventors: Sébastien Weitbruch, Mönchweiler (DE); Cédric Thebault, Villingen (DE); Bernd Bader, Villingen-Schwenningen (DE)

(73) Assignee: Thomson Licensing, Boulogne-Billancourt (FR)

( * ) Notice: Subject to any disclaimer, the term of this patent is extended or adjusted under 35 U.S.C. 154(b) by 399 days.

(21) Appl. No.: 10/437,105

(22) Filed: May 13, 2003

(65) Prior Publication Data

US 2003/0217872 A1 Nov. 27, 2003

(30) Foreign Application Priority Data

May 22, 2002 (EP) ..... 02291252

(51) Int. Cl.
*G09G 3/28* (2006.01)

(52) U.S. Cl. ..... 345/60; 345/690

(58) Field of Classification Search ..... 345/60–66, 345/67, 68, 76–83, 87–100, 204, 690; 315/169.1, 315/169.2, 169.3, 169.4, 169; 313/306, 309, 313/336, 351, 582, 584, 586, 633
See application file for complete search history.

(56) References Cited

U.S. PATENT DOCUMENTS 6,151,001 A * 11/2000 Anderson et al. ..... 345/63
6,256,002 B1 * 7/2001 Shinoda ..... 345/60
6,753,832 B1 * 6/2004 Weitbruch et al. ..... 345/60
6,894,664 B1 * 5/2005 Thebault et al. ..... 345/60
2001/0020923 A1 * 9/2001 Homma ..... 345/60
2001/0028225 A1 * 10/2001 Awamoto ..... 315/169.1

FOREIGN PATENT DOCUMENTS

EP 0874349 A1 10/1998
EP 1174850 A1 1/2002

* cited by examiner

*Primary Examiner*—Nitin Patel
(74) *Attorney, Agent, or Firm*—Joseph J. Laks; Harvey D. Fried; Sammy S. Henig

(57) ABSTRACT

The present invention relates to a method for processing video pictures for display on a display device comprising a plurality of lines constituted by luminous elements called cells corresponding to the pixels of a picture, wherein the time duration of a video frame is divided into a plurality of sub-field periods during which the cells can be activated for light emission, a sub-field period being divided into an addressing period wherein the plurality of lines is scanned line by line, a sustaining period and an erasing period, wherein, in the addressing period, the addressing time is different from one line to an other. The invention is mainly used in PDP technology.

9 Claims, 7 Drawing Sheets

METHOD FOR PROCESSING VIDEO PICTURES FOR DISPLAY ON A DISPLAY DEVICE

The present invention relates to a method for processing video pictures for display on a display device as well as to an apparatus for carrying out said method.

More specifically, the invention relates to a method which improves the brightness and/or the picture quality of pictures which are displayed on matrix displays like plasma display panels (PDP) or other display devices based on the principle of duty cycle modulation (pulse width modulation) of light emission.

BACKGROUND

Today, the Plasma technology makes possible to achieve flat color panels of large size and with very limited depth without any viewing angle constraints. The size of the displays may be much larger than the classical CRT picture tubes would have ever been allowed.

Referring to the last generation of European TV, a lot of work has been made to improve its picture quality. Consequently, a new technology like the Plasma one has to provide a picture quality so good or better than the old standard TV technology. This picture quality can be decomposed in different parameters, such as:

good response fidelity of the panel: A panel having a good response fidelity ensures that only one pixel could be ON in the middle of a black screen and in addition, this panel has to perform a good homogeneity. In order to improve that, a so-called "priming" process is used which aims to excite the whole cells of the panel regularly but only during a short time. Nevertheless, since an excitation of a cell is characterized by an emission of light, the priming process will modify the level of black. Therefore, this solution has to be used parsimoniously.

good brightness of the screen: This is limited by the dead time of the panel, i.e. time in which no light is produced, comprising mostly the addressing time and the erase time.

good contrast ratio even in dark room: This is limited by the brightness of the panel combined with the black level $$\left(\text{ratio}\frac{Brightness}{blacklevel}\right).$$

In order to improve the response fidelity, the use of the "priming" process will, at the same time, reduce the contrast ratio.

All these parameters are also completely linked together and an optimal compromise has to be chosen to provide the best picture quality at the end.

A Plasma Display Panel (PDP) utilizes a matrix array of discharge cells which could only be "ON" or "OFF". Also unlike a CRT or LCD in which gray levels are expressed by analog control of the light emission, a PDP controls the gray level by modulating the number of light pulses per frame. For that purpose, each frame will be decomposed in sub-periods called "sub-fields".

In order to produce these light pulses, an electrical discharge will appear in a gas called plasma and the produced UV radiation will illuminate a colored phosphor.

In standard addressing methods like the method known as ADS (Address Display Separated) all the basic cycles of a such-field period are made one after the other. In order to select which pixel should be lighted, a first selective operation called addressing (or scanning) will create a charge in the cell to be lighted. Each plasma cell can be considered as a capacitor which keeps the charge for a long time. Afterwards, a general operation called "sustain" applied during the lighting period will add charges in the cell. In the cell addressed during the first selective operation, the two charges will build up and that brings between two electrodes of the cell a firing voltage. The cell will light during the whole sustain operation of each specific sub-field.

At the end, an erase operation will remove all the stored charges to prepare the cell for new cycle.

As mentioned above, the PDP controls the gray level by modulating the number of light pulses per frame.

This time modulation will be integrated by the eye over a period corresponding to the human eye time response. In the field of video processing, a 8-bit representation of a luminance level is very common and will be taken as example used to simplify the disclosure.

In that case each level will be represented by a combination of the 8 following bits:

1-2-4-8-16-32-64-128

To realize such a coding scheme with the PDP technology, the frame period will be divided in 8 lighting periods (called sub-fields), each one corresponding to one of the 8 bits. The number of light pulses for the bit "2" is the double as for the bit "1 ", and so forth. With these 8 sub-periods, it is possible through sub-field combination, to build the 256 gray levels. The standard principle used to generate this gray modulation is based on the ADS (Address Display Separated) principle, in which all operations are performed at different time on the whole panel. For illustration, FIG. 1 represents an example of ADS principle based on an 8-bit encoding scheme with only one priming at the beginning of the frame.

Each sub-field SF1, SF2, SF3 . . . SF8 comprises an erase period, an addressing period and a sustain period as shown in detail in FIG. 2. This figure illustrates the fact that except for the addressing period, all operations are performed on the whole panel in an uniform way. The addressing operation, as already said, is a selective operation which is done line by line. The overall duration of the addressing period is commonly called addressing time and represented on the figures with $T_{ad}$. On standard panels, this time is equivalent to the time used for each line ($T_l$) multiplied by the number of lines (N) since the addressing time $T_l$ is the same for all lines. This principle can be seen on FIG. 3.

FIG. 3 shows that, for a given sub-field, the activation of the addressing operation for each line has the same duration $T_l$. Then, the complete addressing time per sub-field is computed as $T_{ad}=N\times T_l$ where N represents the total amount of addressed lines.

Actually, the only variation which can be found in the plasma field is a variation depending on the sub-field itself. In other words, the addressing time for all lines stays the same inside one sub-field writing stage but is different from sub-field to sub-field.

The table A below gives an example of one flexible addressing found on one actual product:

TABLE A

| Sub-field | Sub-field weight | Addressing time |
|---|---|---|
| 1 | 1 | 2.2 μs |
| 2 | 2 | 2.1 μs |
| 3 | 3 | 2.0 μs |

TABLE A-continued

| Sub-field | Sub-field weight | Addressing time |
|---|---|---|
| 4 | 5 | 1.9 μs |
| 5 | 8 | 1.9 μs |
| 6 | 13 | 1.8 μs |
| 7 | 19 | 1.8 μs |
| 8 | 25 | 1.8 μs |
| 9 | 32 | 1.7 μs |
| 10 | 40 | 1.7 μs |
| 11 | 49 | 1.7 μs |
| 12 | 58 | 1.7 μs |

In the example described table A, the addressing time becomes shorter when the sub-field weight increases. This is due to the fact that the more sustain a sub-field contains the better the addressing efficiency is. Therefore this addressing time can also change depending on the power management. When the APL (Average Power level) of the input picture decreases, the overall number of sustains increases and the addressing time per sub-field can be decreased as shown on table B.

TABLE B

| Sub-field | Sub-field weight | Addressing time (APL = 0%) | Addressing time (APL = 20%) | Addressing time (APL = 60%) | Addressing time (APL = 100%) |
|---|---|---|---|---|---|
| 1 | 1 | 2.2 μs | 2.2 μs | 2.3 μs | 2.4 μs |
| 2 | 2 | 2.1 μs | 2.2 μs | 2.3 μs | 2.4 μs |
| 3 | 3 | 2.0 μs | 2.1 μs | 2.2 μs | 2.3 μs |
| 4 | 5 | 1.9 μs | 2.1 μs | 2.2 μs | 2.3 μs |
| 5 | 8 | 1.9 μs | 2.0 μs | 2.2 μs | 2.3 μs |
| 6 | 13 | 1.8 μs | 2.0 μs | 2.2 μs | 2.3 μs |
| 7 | 19 | 1.8 μs | 1.9 μs | 2.1 μs | 2.2 μs |
| 8 | 25 | 1.8 μs | 1.9 μs | 2.1 μs | 2.2 μs |
| 9 | 32 | 1.7 μs | 1.9 μs | 2.0 μs | 2.1 μs |
| 10 | 40 | 1.7 μs | 1.9 μs | 2.0 μs | 2.1 μs |
| 11 | 49 | 1.7 μs | 1.9 μs | 2.0 μs | 2.1 μs |
| 12 | 58 | 1.7 μs | 1.9 μs | 2.0 μs | 2.1 μs |

Therefore, the addressing time could be described as a function of two variables $T_l=f(SF,APL)$ where SF represents the sub-field number and APL the average power level (%).

However, in any case, the addressing time of standard panel stays the same from one line to the other despite the fact that the panel is not homogeneous as well as the influence of various operation like priming, sustaining and so on.

SUMMARY OF THE INVENTION

The object of the present invention is to propose a new addressing method which:

- Improves the panel brightness and/or the picture quality by reducing the dead time using faster addressing: more sustains or more sub-fields can be used.
- Reduces the cost by a better optimization of the addressing time enabling to go towards single scan plasma even for high resolution (half of addressing driver required).
- Presents an alternative to today's dynamic addressing method.

The present invention relates to a method for processing video pictures for display on a display device comprising a plurality of lines constituted by luminous elements called cells corresponding to the pixels of a picture, wherein the time duration of a video frame is divided into a plurality of sub-field periods during which the cells can be activated for light emission, a sub-field period being divided into an addressing period wherein the plurality of lines is scanned line by line, a sustaining period and an erasing period, characterized in that, in the addressing period, the addressing time is different from one line to an other.

According to a preferred embodiment, the addressing period per sub-field is given by the formula $$T_{ad}(SF) = \sum_{n=1}^{n=N} T_l(n, SF),$$

where N represents the total number of lines of the display device, $T_l(n,SF)$ represents the addressing time per line and is defined by $T_l(n,SF)=T_l(SF)XF(n)$ where $T_l(SF)$ represents the average addressing time per line and f(n) a function depending on the line number called factor.

In this case, the speed factor f(n) is function of one ore more of the following characteristics:

panel homogeneity giving a speed factor $f_h(n)$ priming process efficiency giving a speed factor $f_p(n)$ sustaining period efficiency giving a speed factor $f_s(n)$.

When a priming process is used for each sub-field, the speed factor f(n) is equal to $f(n)=f_h(n)Xf_s(n)Xf_p(n)$.

When each sub-field is not preceded by a priming process, the speed factor f(n) is equal to $f(n)=f_h(n)Xf_s(n)$.

According to another embodiment, the speed factor f(n) is determined experimentally by measuring the discharge lag time (DLT) and taking for each line the worse value of the DLT to define the overall speed factor.

In fact, the speed factor f(n) is determined one time for a specific panel technology and stored in a memory of a panel control device.

The present invention relates also to an apparatus for carrying out the method including a peak white enhancement (PWE) control circuit comprising a memory for storing the speed factor associated to each line. The memory is a PROM or a look up table (LUT).

DRAWINGS

Exemplary embodiments of the invention are illustrated in the drawings and are explained in more details in the following description.

In the figures:

FIG. 1 already described shows a sub-fields organization according to the ADS principle;

FIG. 2 already described shows in detail the operations for one such-field;

FIG. 3 already described shows standard addressing waveforms;

EXEMPLARY EMBODIMENTS

Figure 1:
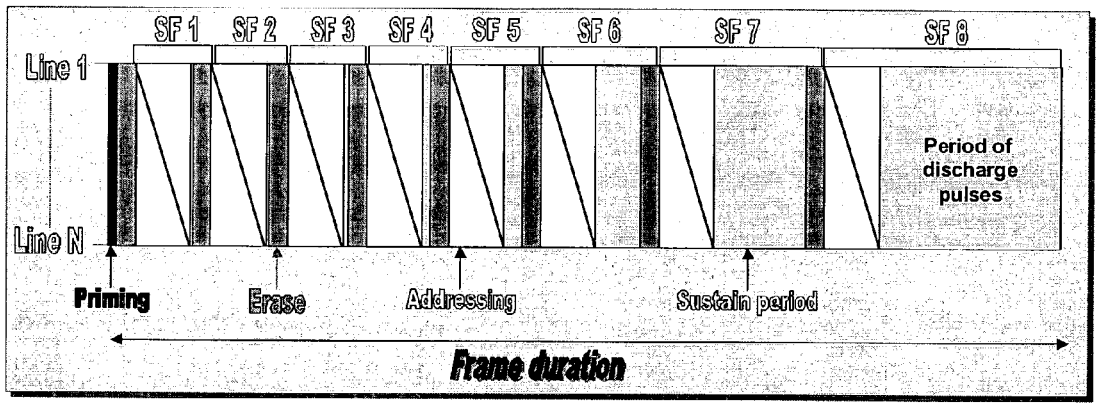
Figure 2:
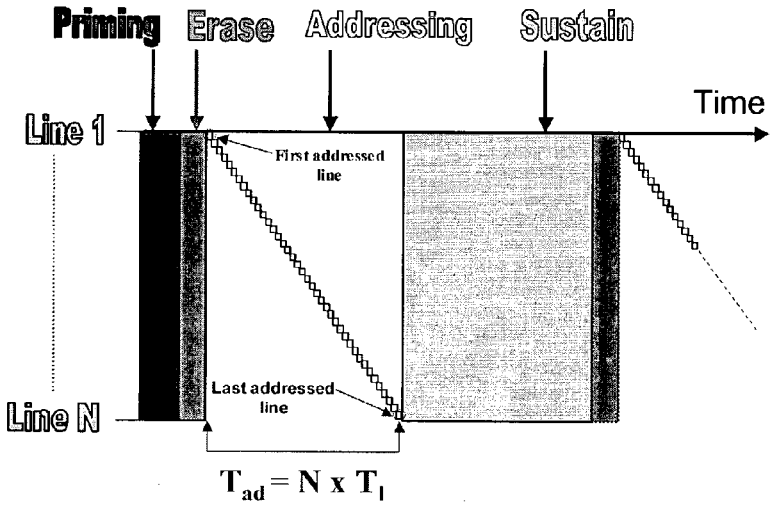
Figure 3:
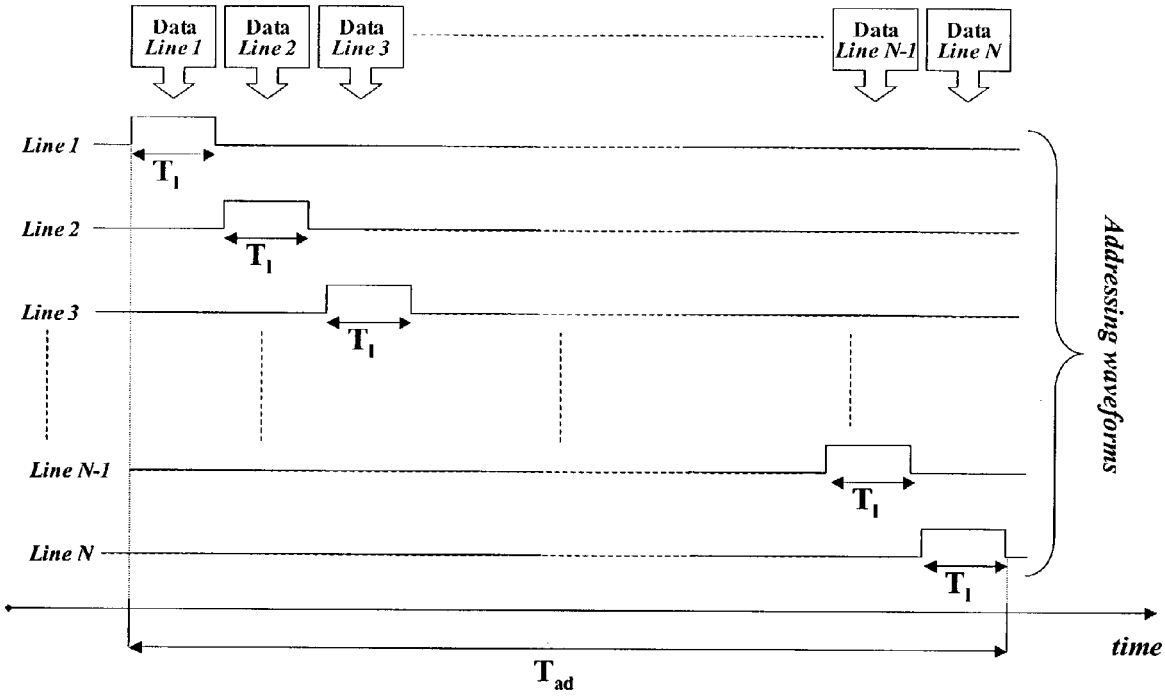
Figure 4:
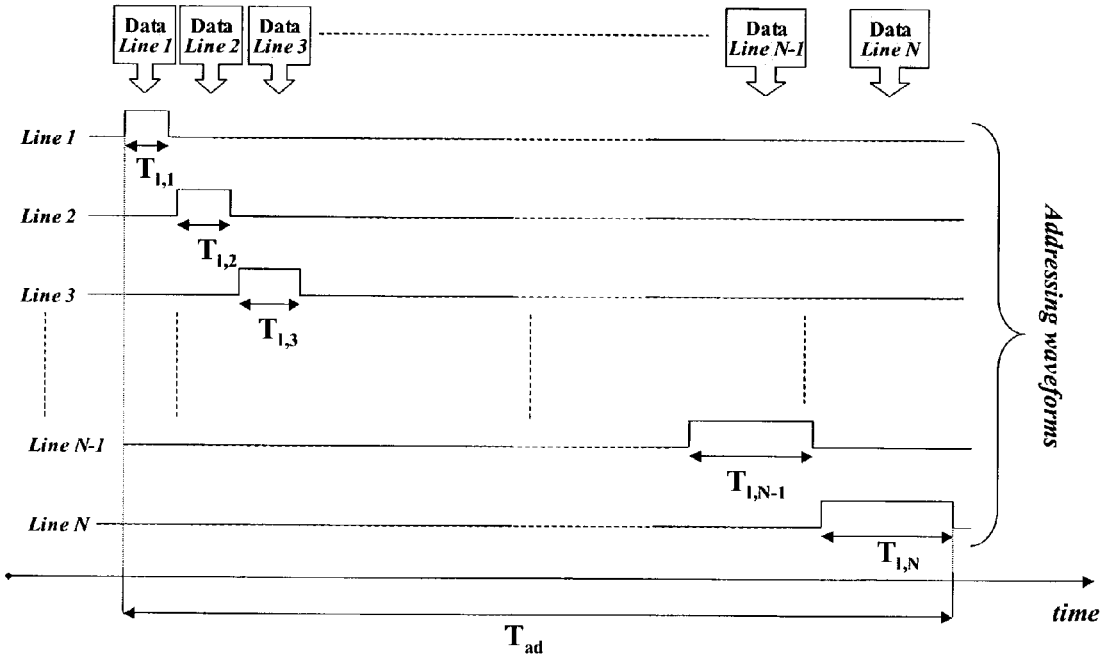
FIG. 4 shows addressing waveforms according to the present invention.

The present invention will be described with reference to FIG. 4. As shown on FIG. 4, the length of the addressing period will be different from line to line, as shown by the length of the addressing pulses Tl,1,; Tl,2; Tl,3; Tl,N-1; Tl,N of the different lines line1, line2, line3 . . . linen-1, lineN.

In that case, the overall addressing time per sub-field becomes:

$$T_{ad}(SF) = \sum_{n=1}^{n=N} T_l(n, SF)$$

where N represents the total number of lines. In order to simplify the exposition, the addressing time per line will be defined as following: $T_l(n,SF)=T_l(SF)\times f(n)$ where $T_l(SF)$ represents the average addressing time per line and f(n) a function of the line number called speed factor. Under this assumption, the value $T_l(SF)$ will be similar to the standard addressing time known today (e.g. shown in Table B) and will follow the same rules.

Concerning the evolution of the addressing time per line, there are three categories of dependency:

- A panel homogeneity dependency: this parameter is related to the fact that the panel does not have the same behavior among the whole screen.
- A dependency of priming efficiency: the priming operation enables a rapid writing but its efficiency could decrease in the time (depending on panel technology).
- A dependency of sustain efficiency: the writing operation is directly followed by the sustain operation. Since the efficiency of the writing operation is linked to the capacity effect of the panel, this could change with the delay to the sustain operation.

Figure 5:
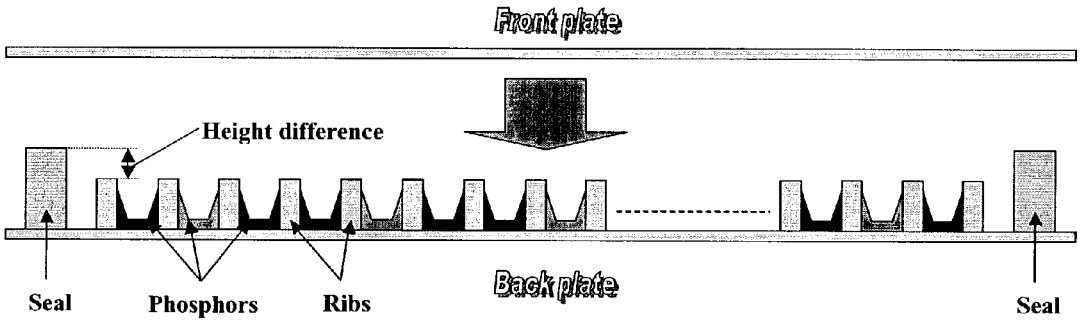
FIG. 5 is a schematic view of a panel structure before sealing.

In the following paragraphs, the influence of each of these parameters will be described Panel Homogeneity Dependency:

As shown on FIG. 5, a plasma panel structure comprises a black plate 1 on which are located ribs 2. The ribs defined the walls of the cells. The data electrodes are deposited between the ribs and are covered with different kinds of phosphors 3 giving the three colors RGB. As shown on FIG. 5, a seal 4 is deposited on the borders of the plate. The height of the seal is higher that the height of the ribs. The panel also comprises a front plate 5 which receives the line electrodes.

Figure 6:
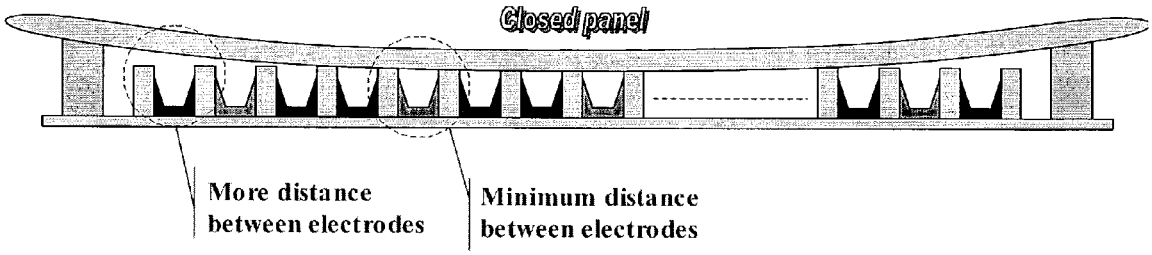
FIG. 6 is a schematic view of a panel structure after sealing.
Figure 7:
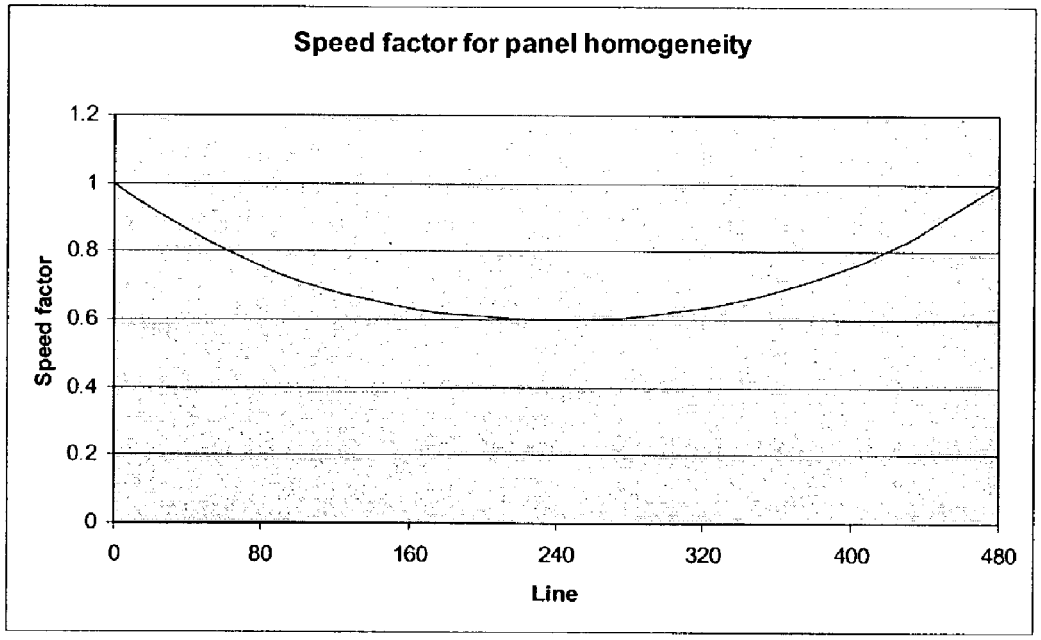
FIG. 7 is a graph of an example of speed factor for panel homogeneity.

In this case, the writing operation is done through a discharge between the data electrode (vertical) located on the back plate 1 and the line or scan electrode (horizontal) located on the front plate 5. Therefore, the efficiency of the discharge will depend on the distance between the two plates 1,5 determined by the height of the ribs. This distance should stay constant among the screen but, due to technology issues, this is not the case. In fact, the distance between the two plates is bigger at the border of the plate because the seal is higher than the ribs themselves. This is illustrated on FIG. 6. This figure shows that the distance between data electrode and scan electrode is the biggest (seal height) at the border of the panel and decreases towards the minimal one (ribs height) in the middle of the panel. Moreover, since the addressing time will increase with that distance, the speed factor for the panel homogeneity $f_h(n)$ will have a behavior as described on the graphic represented on FIG. 7 giving the speed factor function of the position along a line. The curve has been drawn for a single scan WVGA panel with 480 lines addressed one after the other from the top up to the bottom. However, various other configurations can be used with more or less lines, reverse addressing order, dual scan, and so on.

Figure 8:
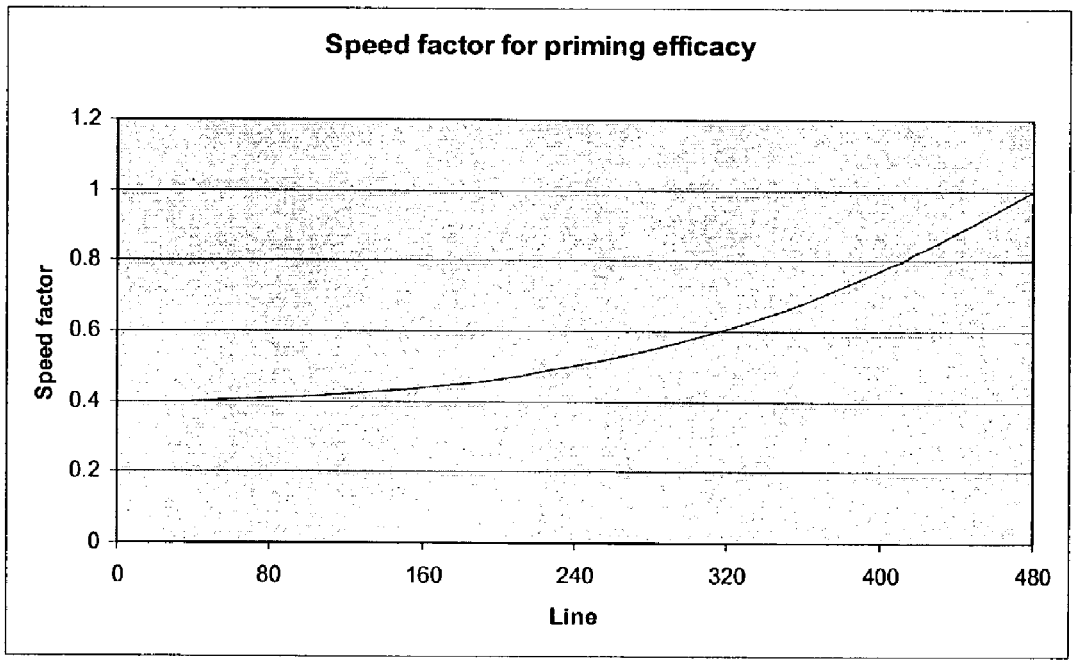
FIG. 8 is a graph of an example of speed factor for priming efficiency.

Priming Efficiency:

As known, the writing operation can be preceded by a kind of pre-ionization of cells called priming, which improves the writing process. During the priming stage, some charges are set inside the cell to reduce its inertia. Obviously, this priming efficiency will decrease with the time as well as the charges will decrease with the time too. In other words, the first lines written directly after the priming operation could be addressed much faster than the ones written at the end (last lines). Due to that behavior, the corresponding speed factor $f_p(n)$ will have a behavior as described on the graphic of FIG. 8.

Figure 9:
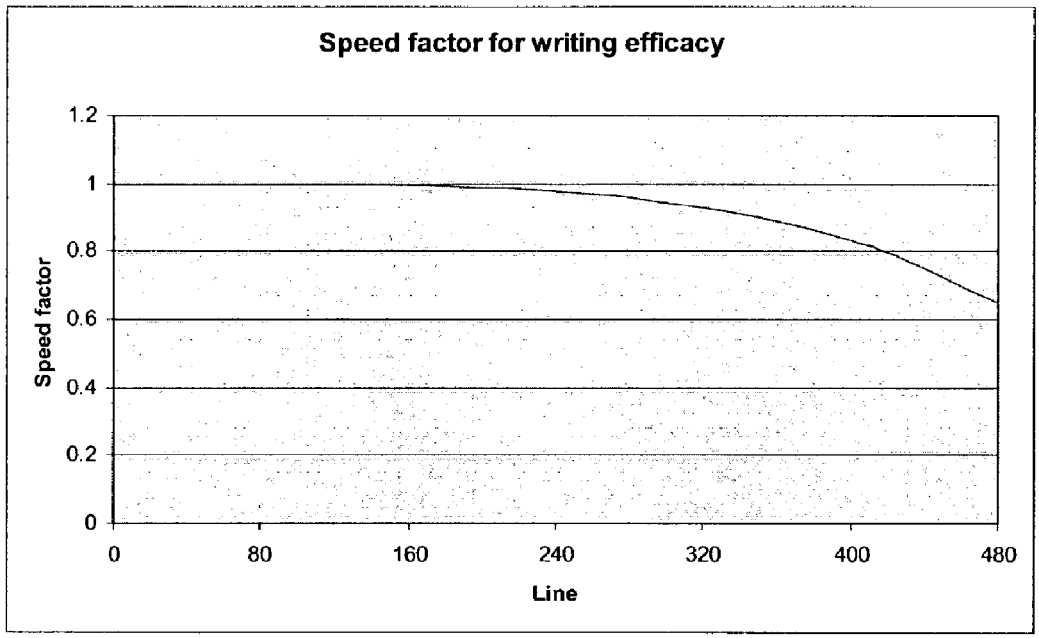
FIG. 9 is a graph of an example of speed factor for writing efficiency.

Addressing Efficiency and Sustain Operation:

The writing operation is based on the generation of a charge inside the cell that will be sustained later. As in the case of the priming charges, the writing charges will also decrease with the time before the sustain operation occurs. In other words, the lines which are located shortly before the sustain period (last lines) can be addressed faster than the other (first lines). Due to that behavior, the corresponding speed factor $f_s(n)$ will have a behavior as described on the graphic of FIG. 9.

According to the present invention, the overall speed factor will be a combination of one or more of the above speed factors. Among others, the overall speed factor will depend of the fact that each sub-field is preceded or not by a priming operation as described for example in WO 00/46782 filed in the name of the same company.

Figure 10:
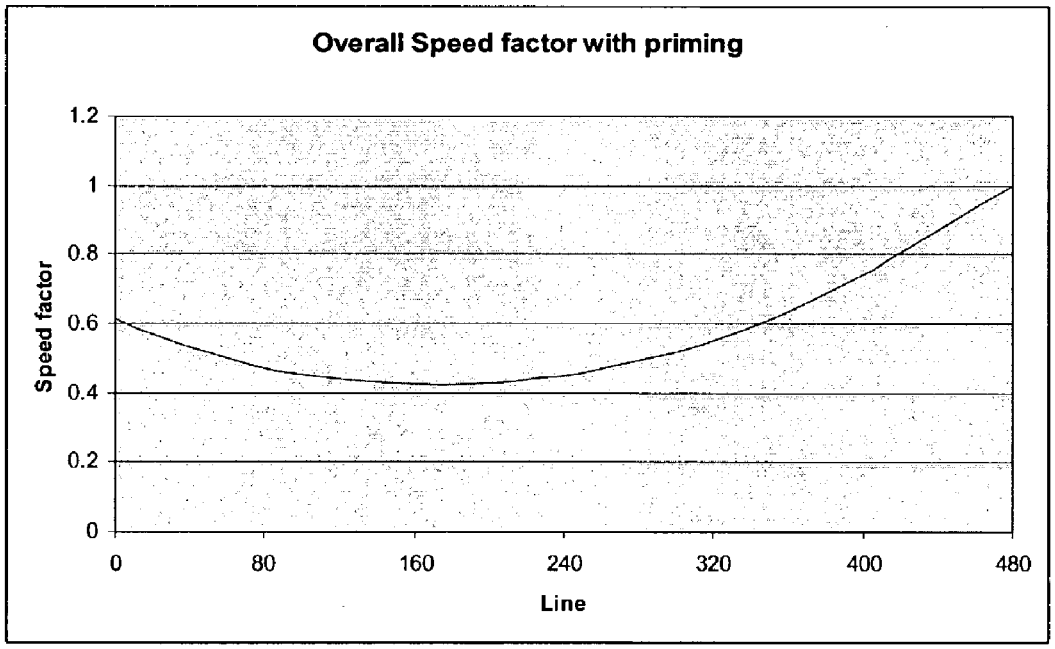
FIGS. 10 and 11 are graphs of an example of the overall speed factor respectively with and without priming.

So, when sub-field is preceded by a priming operation, the overall speed factor will be the combination of all three precedent factors under the form: $f_{PSF}(n)=f_h(n)\times f_p(n)\times f_s(n)$ as shown on the FIG. 10.

Figure 11:
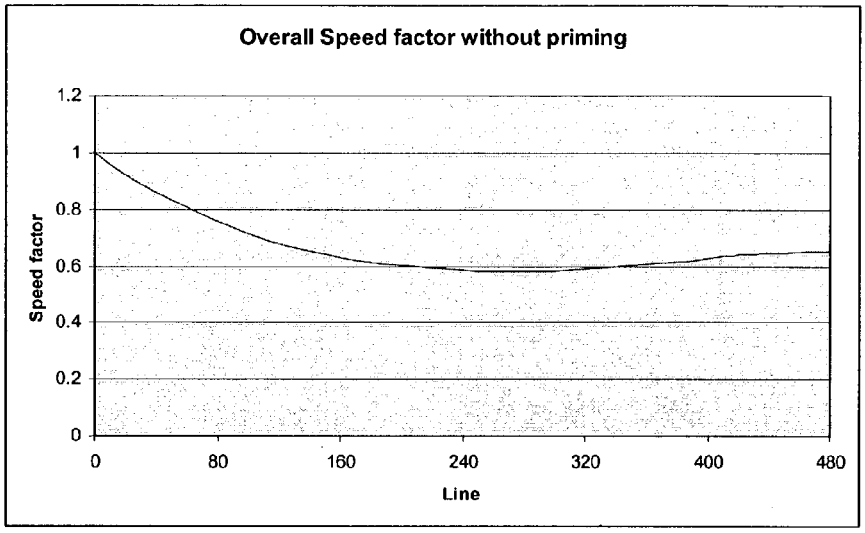

When sub-field is not preceded by a priming operation, the overall speed factor will be a combination of two factors only: the speed factor related to the panel homogeneity and the speed factor related to the writing efficiency under the form: $f_{RSF}(n)=f_h(n)\times f_s(n)$ as shown on the next FIG. 11.

Obviously, depending on the panel technology, one or more of the previously described speed factor function can have a different behavior and that will have a direct impact on the form of the overall curve. Moreover, all the curves presented here are only examples related to a specific technology. In any case, a characterization of the panel speed should be made specifically for each technology and each new process.

Above the speed factor has been determined by calculation. However, the evaluation of the overall speed factor can be made experimentally rather than theoretically. For that purpose, the discharge lag time (DLT) or writing discharge jitter will be measured among the screen for the case of primed and not-primed sub-fields. This measurement is made using a light sensor adapted to the IR emission occurring during the writing discharge. Then the measurement of the delay between the start of the writing operation and the discharge define the so-called DLT. The worse case of the DLT should be measured for each line in order to define the overall speed factor.

In the past, the addressing speed chosen for a specific panel is made in order to have a perfect response fidelity and homogeneity on the whole screen with a certain voltage margin for writing and sustaining. These kinds of measurements have lead to the definition of addressing table as shown on tables A and B.

However, when the addressing speed chosen for a specific mode is 2.1 μs (e.g. Table B for an APL=20% and for the third sub-field) this means that this speed corresponds to the most critical situation. In other words it corresponds to the worse line.

However, with the concept of the present invention, a various addressing speed for each line is obtained. Then, the speed of each line can be adapted so that the worse line will be at 2.1 μs. This is illustrated below for the case of one sub-field with priming and one sub-field without priming.

Figure 12:
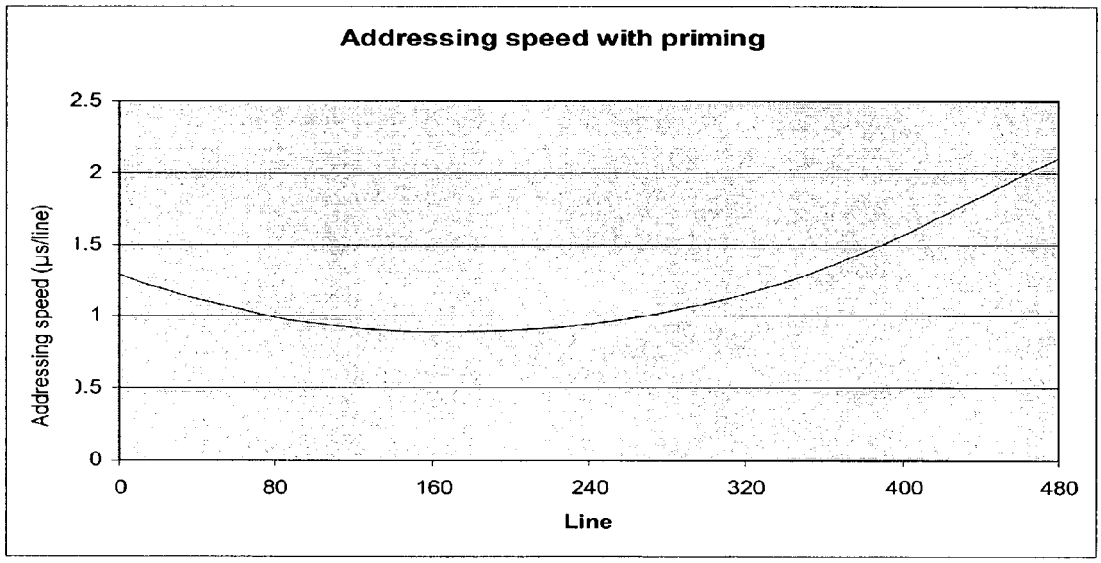
FIGS. 12 and 13 are graphs giving the addressing speed respectively with and without priming.
Figure 13:
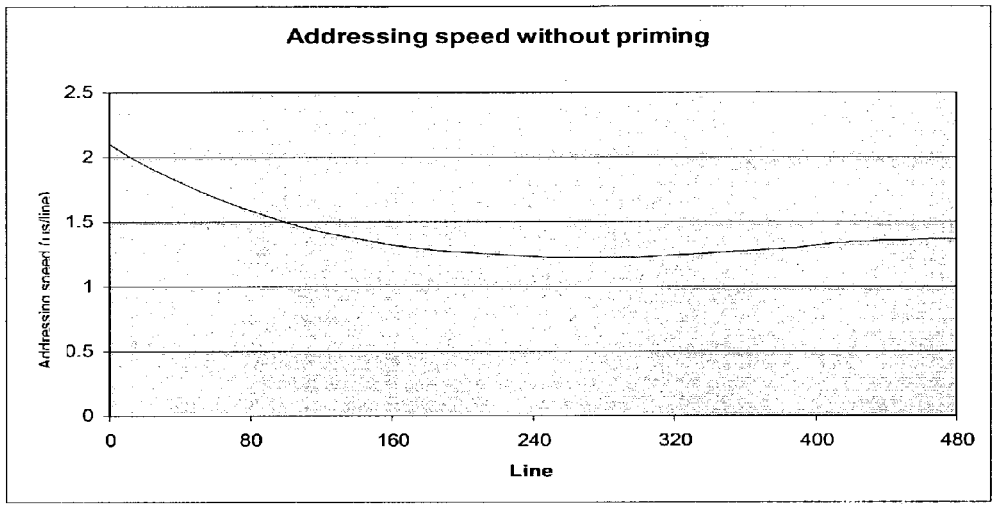

In the result presented FIG. 12 relating to sub-field with priming, the worst case is located at the last addressed line but the average addressing speed is now 1.18 μs instead of 2.1 μs. In other words, for 480 lines the complete addressing period will be 566 μs instead of 1008 μs.

In the case presented FIG. 12 relating to sub-field without priming, the worst case is located at the first addressed line but the average addressing speed is now 1.42 μs instead of 2.1 μs. In other words, for 480 lines the complete addressing period will be 682 μs instead of 1008 μs.

As already said, all values presented here are only examples required to simplify the exposition. The results should be taken carefully since they are directly related to the panel technology.

Figure 14:
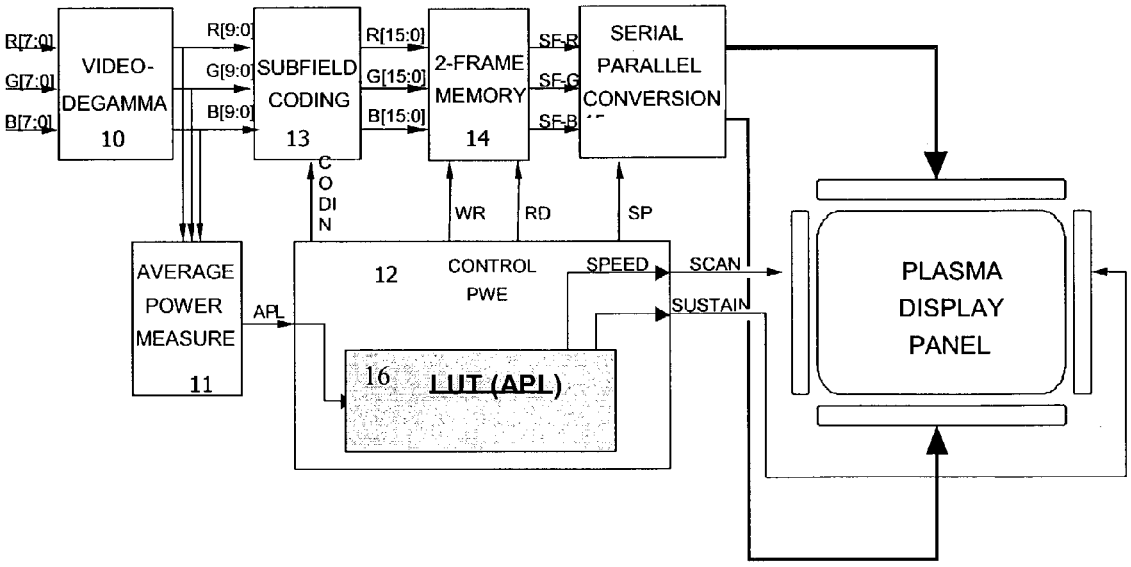
FIG. 14 is a block diagram of the apparatus according to the invention.

FIG. 14 represents a possible implementation of an apparatus for carrying out the method of the invention. This type of apparatus is already described in PCT application WO 00/46782. It comprises a video degamma circuit 10. RGB data from circuit 10 is analyzed in a an average power measure circuit 11 which gives the computed average power value (APL) to the PWE (peak white Enhancement) control circuit 12. One computation can be done as following:

$$APL = \frac{1}{3 \cdot M} \cdot \sum_{m=1}^{m=M} (R_m + G_m + B_m)$$

where M represents the total amount of pixels. The control PWE circuit 12 consults its internal power level mode table located in a LUT and directly generates the selected mode control signals for the other processing circuits. It selects the sustain table to be used and the subfield encoding table to be used (CODING). It also controls the writing of RGB pixel data in the frame memory 14 (WR), the reading of RGB subfield data from the second frame memory 14 (RD), and the serial to parallel conversion circuit 15 (SP). Finally it generates the SCAN and SUSTAIN pulses required to drive the PDP driver circuits. Also in that case, the length of the addressing signal (addressing speed) will be taken from the LUT 16 and this, for each line of the panel.

Two frame memories are required. Data is written pixel-wise, but read sub-field-wise. In order to read the complete first sub-field a whole frame must already be present in the memory. In a practical implementation two whole frame memories are present, and while one frame memory is being written, the other is being read, avoiding in this way reading the wrong data. In a cost optimized architecture, the two frame memories are probably located on the same SDRAM memory IC, and access to the two frames is time multiplexed.

The whole computation of all parameters from the concept of the present invention will be made one time for a given panel technology and then stored in the PROM or LUT of the plasma dedicated IC.

What is claimed is:

1. A method for processing video pictures for display on a display device comprising a plurality of lines constituted by luminous elements called cells corresponding to the pixels of a picture, wherein the time duration of a video frame is divided into a plurality of sub-field periods during which the cells can be activated for light emission, a sub-field period being divided into an addressing period wherein the plurality of lines is scanned line by line, a sustaining period and an erasing period, wherein, in the addressing period, the addressing duration is different from one line to another.

2. The method according to claim 1, wherein the speed factor f(n) is determined one time for a specific panel technology and stored in a memory of a panel control device.

3. A method for processing video pictures for display on a display device comprising a plurality of lines constituted by luminous elements called cells corresponding to pixels of a picture, wherein the time duration of a video frame is divided into a plurality of sub-field periods during which the cells can be activated for light emission, a sub-field period being divided into an addressing period wherein the plurality of lines is scanned line by line, a sustaining period and an erasing period, comprising addressing lines for a different duration from one line to another; wherein the addressing period ($T_{ad}$) per sub-field (SF) is given by the formula $$T_{ad}(SF) = \sum_{n=1}^{n=N} T_l(n, SF),$$

where N represents the total number of lines of the display device and $T_l(n,SF)$ represents the addressing duration per line and is defined by: $T_l(n,SF)=T_l(SF)\times f(n)$, where $T_l(SF)$ represents the average addressing duration per line l and $f(n)$ is a speed factor that is a function of the line number n.

4. The method according to claim 3, wherein the speed factor f(n) is a function of one ore more of the following characteristics:

panel homogeneity giving a speed factor $f_h(n)$;

priming process efficiency giving a speed factor $f_p(n)$; and sustaining period efficiency giving a speed factor $f_s(n)$.

5. The method according to claim 4, wherein, when a priming process is used for each sub-field, the speed factor f(n) is equal to:

$$f(n)=f_h(n)\times f_s(n)\times f_p(n).$$

6. The method according to claim 4, wherein, when each sub-field is not preceded by a priming process, the speed factor f(n) is equal to:

$$f(n)=f_h(n)\times f_s(n).$$

7. The method according to claim 3, wherein the speed factor f(n) is determined experimentally by measuring the discharge lag time (DLT) and taking for each line the worst value of the DLT to define the overall speed factor.

8. Apparatus for processing video pictures to be displayed on a display device comprising a plurality of lines constituted by luminous elements called cells corresponding to pixels of a picture, processing circuits for processing RGB data of a picture and driving circuits for driving said cells, said apparatus comprising an average power measure circuit receiving said RGB data and giving a computed average power value, and a peak white enhancement (PWE) control circuit comprising a memory for storing a speed factor associated to each line and receiving the computed average power value and outputting control signals to said processing and driving circuits.

9. The apparatus according to claim 8 wherein the memory is a PROM or a look up table.

* * * * *